US009851694B2

(12) United States Patent
Fladl et al.

(10) Patent No.: US 9,851,694 B2
(45) Date of Patent: Dec. 26, 2017

(54) WATCH, IN PARTICULAR WRIST WATCH

(71) Applicants: Heinz Fladl, Salzburg (AT); Harald Wiesleitner, Salzburg (AT)

(72) Inventors: Heinz Fladl, Salzburg (AT); Harald Wiesleitner, Salzburg (AT)

( * ) Notice: Subject to any disclaimer, the term of this patent is extended or adjusted under 35 U.S.C. 154(b) by 0 days.

(21) Appl. No.: 15/302,045

(22) PCT Filed: Apr. 2, 2015

(86) PCT No.: PCT/AT2015/050088

§ 371 (c)(1),
(2) Date: Oct. 5, 2016

(87) PCT Pub. No.: WO2015/154114

PCT Pub. Date: Oct. 15, 2015

(65) Prior Publication Data

US 2017/0123378 A1 May 4, 2017

(30) Foreign Application Priority Data

Apr. 7, 2014 (AT) ..... A50257/2014

(51) Int. Cl.
*G04B 19/20* (2006.01)

(52) U.S. Cl.
CPC ..... *G04B 19/207* (2013.01); *G04B 19/20* (2013.01)

(58) Field of Classification Search
CPC .. G04B 19/20; G04B 19/207; G04C 17/0008; G04C 17/0016
See application file for complete search history.

(56) References Cited

U.S. PATENT DOCUMENTS 1,776,001 A 9/1930 Konigsberg
4,161,098 A 7/1979 Ingendahl
4,752,919 A * 6/1988 Clark ..... G04B 19/00 368/223
5,331,609 A * 7/1994 Gubin ..... G04B 19/207 368/223
7,845,846 B2 * 12/2010 Gerber ..... G04B 1/10 368/142

(Continued)

FOREIGN PATENT DOCUMENTS

DE 26 08 457 A1 9/1976
DE 202 06 965 U1 8/2002

(Continued)

OTHER PUBLICATIONS

International Search Report of PCT/AT2015/050088, dated Oct. 5, 2015.

*Primary Examiner* — Sean Kayes
(74) *Attorney, Agent, or Firm* — Collard & Roe, P.C.

(57) ABSTRACT

A watch is described, in particular a wrist watch, having a housing (1), having a dial (3) arranged in the housing (1), having at least one endless conveyor (8), which is guided around two deflection guides (7) having deflection axes parallel to the dial (3), for at least one hand (5), and having a drive for the endless conveyor (8). To provide advantageous structural conditions it is proposed that the dial (3) extending between the two sides of the endless conveyor (8) be mounted on a mount (11), which is either provided laterally outside the orbit of the hand (5) or is fastened laterally outside the orbit of the hand (5).

10 Claims, 8 Drawing Sheets

(56) References Cited

U.S. PATENT DOCUMENTS

| | | | | |
|---|---|---|---|---|
| 8,693,293 | B2 * | 4/2014 | Wilbur | G04B 19/207<br>368/223 |
| 9,304,495 | B2 * | 4/2016 | Wilbur | G04B 19/207 |

FOREIGN PATENT DOCUMENTS

| | | | |
|---|---|---|---|
| EP | 2 230 574 | A1 | 8/1987 |
| EP | 0 677 796 | A1 | 10/1995 |
| EP | 2 230 573 | A1 | 9/2010 |
| GB | 2 384 063 | A | 7/2003 |

* cited by examiner

WATCH, IN PARTICULAR WRIST WATCH

CROSS REFERENCE TO RELATED APPLICATIONS

This application is the National Stage of PC/AT2015/050088 filed on Apr. 2, 2015, which claims priority under 35 U.S.C. §119 of Austrian Application No. A50257/2014 filed on Apr. 7, 2014, the disclosure of which is incorporated by reference. The international application under PCT article 21(2) was not published in English.

FIELD OF THE INVENTION

The invention relates to a watch, in particular a wrist watch, having a housing, having a dial arranged in the housing, having at least one endless conveyor, which is guided around two deflection guides having deflection axes parallel to the dial, for at least one hand, and having a drive for the endless conveyor.

DESCRIPTION OF THE PRIOR ART

In watches, the hands of which are moved along a linear timescale (DE 202 06 965 U1), providing an endless conveyor guided around deflection wheels in the form of a toothed belt drive and arranging the dial laterally adjacent to the upper toothed belt side is known, so that the hands connected to the toothed belt drive overlap the dial having the timescale. To take into consideration the uneven movement of the hands in the deflection region of the toothed belt in a projection on the dial, the hands are concealed in the deflection region of the toothed belt, which requires a circumferential length of the toothed belt, which carries three hands arranged at equal distance to one another, three times the dial length, so that upon one hand leaving the dial, another hand enters the region of the dial and thus a continuous time display is ensured. These known watches have the disadvantage, however, of the required excess length of the toothed belt, the space requirement of which opposes the use of such watches as wrist watches.

Another known watch (EP 0 677 796 A1) avoids such an excess length of the traction mechanism, which is guided endlessly around deflection rollers, for the hands in that two hands are arranged at at a distance corresponding to half of the circumferential length of the endless traction mechanism on the endless conveyor, so that in the vertexes of the deflection guides provided by the deflection rollers, one of the two hands moves out of the region of the lower traction mechanism side into the visible region of the upper traction mechanism side, while the other hand moves into the concealed region of the lower traction mechanism side. Because the dial extending laterally adjacent to the upper traction mechanism side has to have free hand passages in the transition region to the two deflection guides, in order to be able to move the hands overlapping the dial around the deflection guides, the deflection regions cannot be used for a time display, however. For the this reason, the drive for the endless conveyor is suddenly moved further by the length of the deflection guide, so that upon entry of a hand through the hand passage at the end of the timescale, the second hand becomes visible at the beginning of the timescale, which is accompanied by a substantial structural expenditure, however.

SUMMARY OF THE INVENTION

The invention is therefore based on the object of embodying a watch having at least one hand movable along a linear timescale so that, simple structural conditions can be ensured, without endangering telling time in the deflection region of the endless conveyor accommodating the hands.

Proceeding from a watch of the type mentioned at the outset, the invention achieves the stated object in that the dial extending between the two sides of the endless conveyor is mounted on a mount which is either provided laterally outside the orbit of the hands or is fastened laterally outside the orbit of the hands.

The measure of relocating the dial into the region between the two sides of the endless conveyor opens up the possibility of extending the dial into the region of the deflection guides of the endless conveyor, so that the deflection region can also be used for telling time. Because the deflection radius of the deflection guides can be kept small, the circumstance that the path unit of a hand, which is carried along by the endless conveyor, projected in the deflection region onto the dial is represented in substantially shortened form does not have a decisive role for the time telling accuracy. The arrangement of the dial in a plane containing the axes of the deflection guide makes the fastening of the dial more difficult, however because a free hand path has to be ensured both on its upper side and also on its lower side. To take this circumstance into consideration, the dial extends through between the two sides of the endless conveyor, so that the section of the dial protruding between the two sides of the endless conveyor can be fastened laterally outside the orbit of the hands on a corresponding mount in the housing. However, it is also possible to provide a mount extending between the sides of the endless conveyor, which is provided laterally outside the orbit of the hands in the housing. In this case, the dial can be supported in the region of the orbit of the hands on the mount engaging between the sides.

The deflection guides of the endless conveyor themselves can be used as the mount for the dial engaging between the sides of the endless conveyor, so that the dial is supported on the deflection guides. For the typical case in which the deflection guides are formed by deflection rollers, this means that the dial is mounted on the axes or shafts of the deflection rollers.

As already stated, the arrangement according to the invention of the dial offers the simple structural conditions to equalize the length of the dial to the vertex spacing of the two deflection guides. However, difficulties result in providing well-readable timescales in the vertex region of the deflection guides, and do so because of the scale steps, which shorten in the deflection region. If the dial is extended in length by supplementary dial sections while leaving open a hand passage, the lengthened dial sections thus offer the simple possibility of indicating the point in time corresponding to the vertex on the extended dial section.

The structural conditions provided by the dial arrangement according to the invention enable a varied design of the time display. The endless conveyor can thus have, in a way known per se, two hands in a mutual spacing corresponding to half of its circumferential length, without having to provide a sudden further conveyance of the endless conveyor by the circumferential length of the deflection guides, when the hands reach the region of the two deflection guides. As soon as one hand is moved at the end of the dial from its upper side to the lower side, the other hand arrives at the beginning of the dial from the dial lower side at the upper side, which ensures continuous telling of time and makes the transition between the two time intervals defined by the respective timescale particularly clear, when both hands are located in the vertex of the deflection guides of the endless conveyor.

A continuous time display with the aid of an endless conveyor is possible not only with the aid of two hands which are diametrically opposite in the vertex region of the deflection guides, but rather also using only one hand, if this hand interacts, on the one hand, with the dial between the two sides and, on the other hand, with an additional dial, which is arranged below the endless conveyor and is exposed by the dial between the two sides. If the hand above the dial is moved between the two sides of the endless conveyor, the respective time can thus be told on this dial. In the region of the lower side, the hand is concealed by the dial between the sides, but moves above the additional dial, which is arranged below the endless conveyor, and is exposed by the dial between the two sides and therefore is visible. The lower dial is therefore to be provided with a timescale extending in the opposite direction to the dial between the two sides.

As a result of the small amount of space available in wrist watches, the endless conveyors have to be designed as comparatively delicate, so that it is difficult for strength reasons, for example, to mount hands extending over the width of a wrist watch on one side. To provide a remedy here, the endless conveyor can have two endlessly circulating traction mechanisms, which are arranged with lateral spacing in parallel and accommodate at least one hand between them. The hands can therefore be connected at both ends to the endlessly circulating traction mechanism, for which a synchronous drive is required, which is structurally simple to achieve using simple means, however. This is true in particular for the case in which the deflection guides are designed as deflection rollers and are seated in pairs on a shared shaft.

Endless conveyors drivable separately from one another are to be provided for the display of different time units, for example, hours and minutes. To provide comparatively simple structural conditions for such endless conveyors drivable separately from one another, the endless conveyors provided for each time unit to be displayed can be provided with coaxial deflection guides of equal size and with a shared dial, wherein the hand path of the respective outer endless conveyor overlaps that of the inner endless conveyor. As a result of the coaxial deflection guides of equal size, a dial shared by the provided endless conveyors can be used, which has corresponding timescales for the different time units. The hand paths of the individual endless conveyors do not obstruct one another, because they extend with radial spacing from one another, which increases step-by-step with respect to the dial from the inner to the outer endless conveyor.

BRIEF DESCRIPTION OF THE DRAWING

The subject matter of the invention is shown by way of example in the drawing. In the figures

DESCRIPTION OF THE PREFERRED EMBODIMENT

Figure 1:
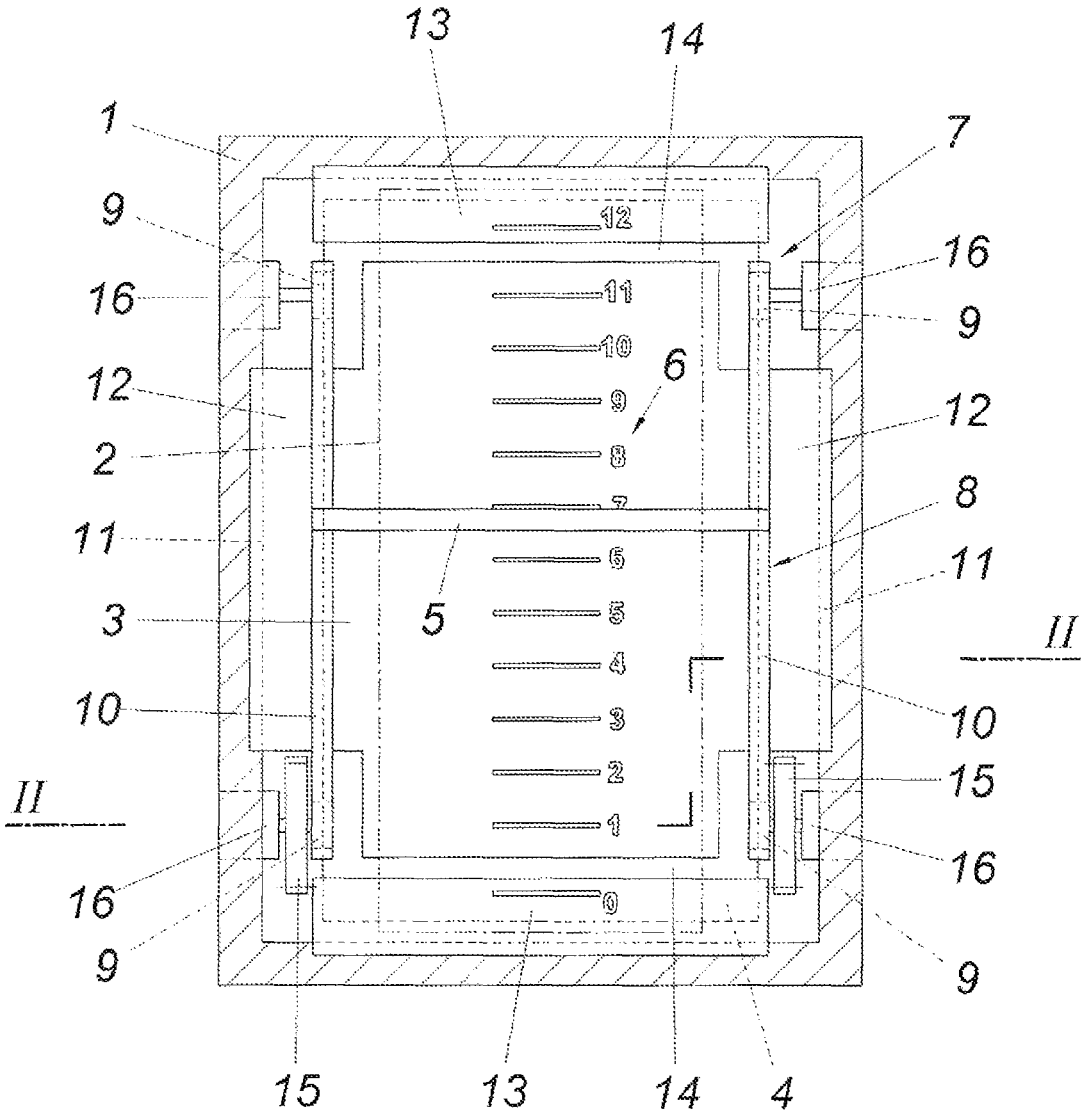
FIG. 1 shows a watch according to the invention in a housing section in parallel to the dial.

The watches according to the exemplary embodiments each have a housing 1, which is only shown schematically, having a viewing window 2, which exposes the view of a dial 3, which is arranged above a watch mechanism 4. With the aid of this watch mechanism 4, at least one hand 5 is moved along a linear timescale 6, which is provided on the dial 3, and this is done with the aid of an endless conveyor 8 guided around deflection guides 7.

Figure 2:
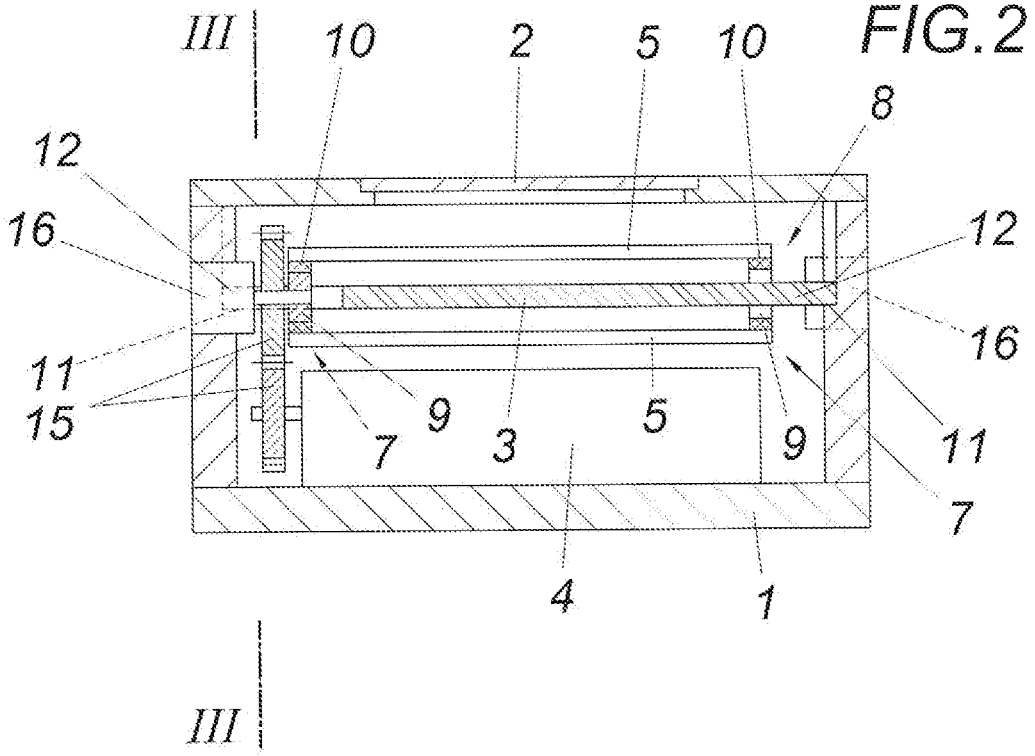
FIG. 2 shows a section along line II-II of FIG. 1.
Figure 3:
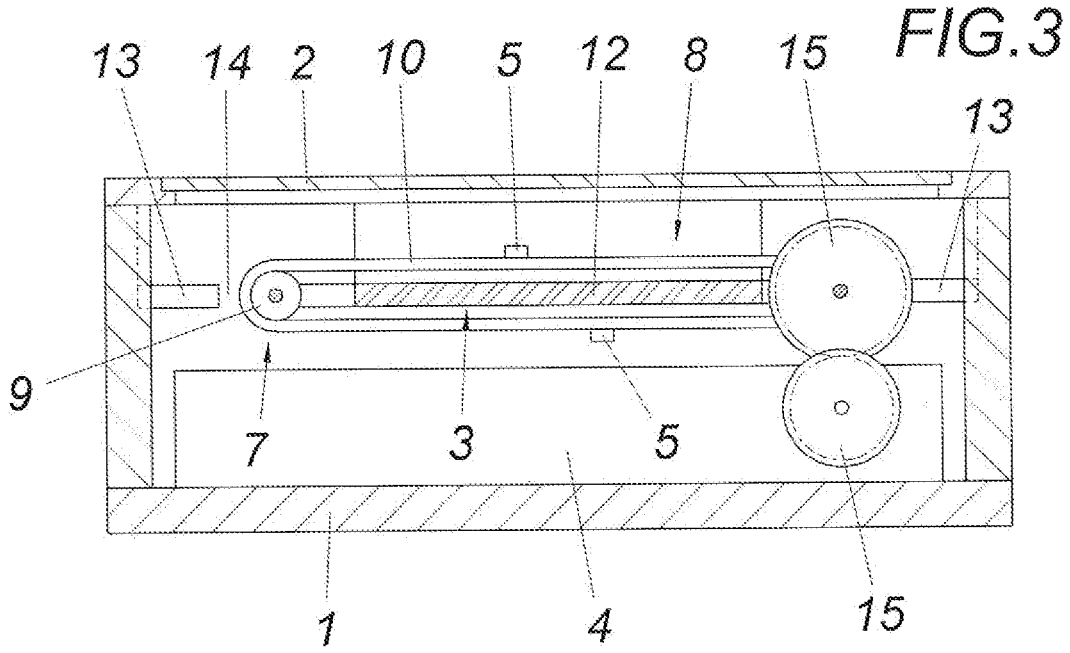
FIG. 3 shows a section along line of FIG. 2.

According to the exemplary embodiment according to FIGS. 1 to 3, the endless conveyor 8 is constructed from two traction mechanisms 10, which are arranged in parallel and are guided endlessly around deflection rollers 9, and which accommodate two hands 5 in a spacing corresponding to half the circumferential length of the endless traction mechanisms 10. Because the dial 3 according to FIGS. 2 and 3 extends between the two sides of the endlessly guided traction mechanisms 10 and is located in the shared axial plane of the deflection rollers 9, the dial 3, the length of which corresponds to the vertex spacing of the deflection guides 7, conceals in each case the hands 5 moved on the lower side, so that with the exception of the hands 5 opposite to one another in the vertex regions of the deflection guides 7 of the endless conveyor 8, only one of the two hands 5 is visible at a time and enables the reading of the time units along the timescale 6. If the visible hand 5 is moved at the end of the timescale 6 via the deflection guides 7 from the upper side to the lower side of the dial 3, the opposing hand 5 thus appears in the visible dial region, which makes continuous time telling possible. To be able to differentiate the two time sections displayed by the two hands 5 from one another, the two hands 5 can be designed differently, for example, can have different colors or shapes.

Because of the fact that the hand path encloses the dial 3 in length, the dial 3 has to be fastened to a mount 11 outside the region of the hand path. This mount 11 is indicated in the exemplary embodiment by a housing shoulder 11, on which the dial 3 is supported with fastening sections 12 extending between the sides of the endlessly guided traction mechanism 10 in relation to the housing 1.

As may be inferred from FIG. 1, difficulties result with respect to the unit steps of the timescale 6 in the region of the deflection guides 7 of the endless conveyor 8, because these unit steps are defined by the projection on the dial 3 of the path length of the hands 5 covered in the region of the deflection guides 7 in the time, unit. To provide a remedy here and enable good readability of the timescale 6, the dial 3 can be supplemented in length by supplementary dial sections 13, which are mounted in the housing 1 while leaving a hand passage 14 and each have the end unit of the timescale 6.

Gearwheel pairs 15 on opposing longitudinal sides of the dial 3 are used for the synchronous drive of the two endless traction mechanisms 10 of the endless conveyor 8, so that one pair of deflection rollers 9 is driven in each case by the watch mechanism 4. So as not to interfere with the longitudinal extension of the dial 3, the shafts or axes accommodating the deflection rollers 9 are mounted freely protruding in corresponding bearings 16 of the housing 1 which is not required, however.

Figure 4:
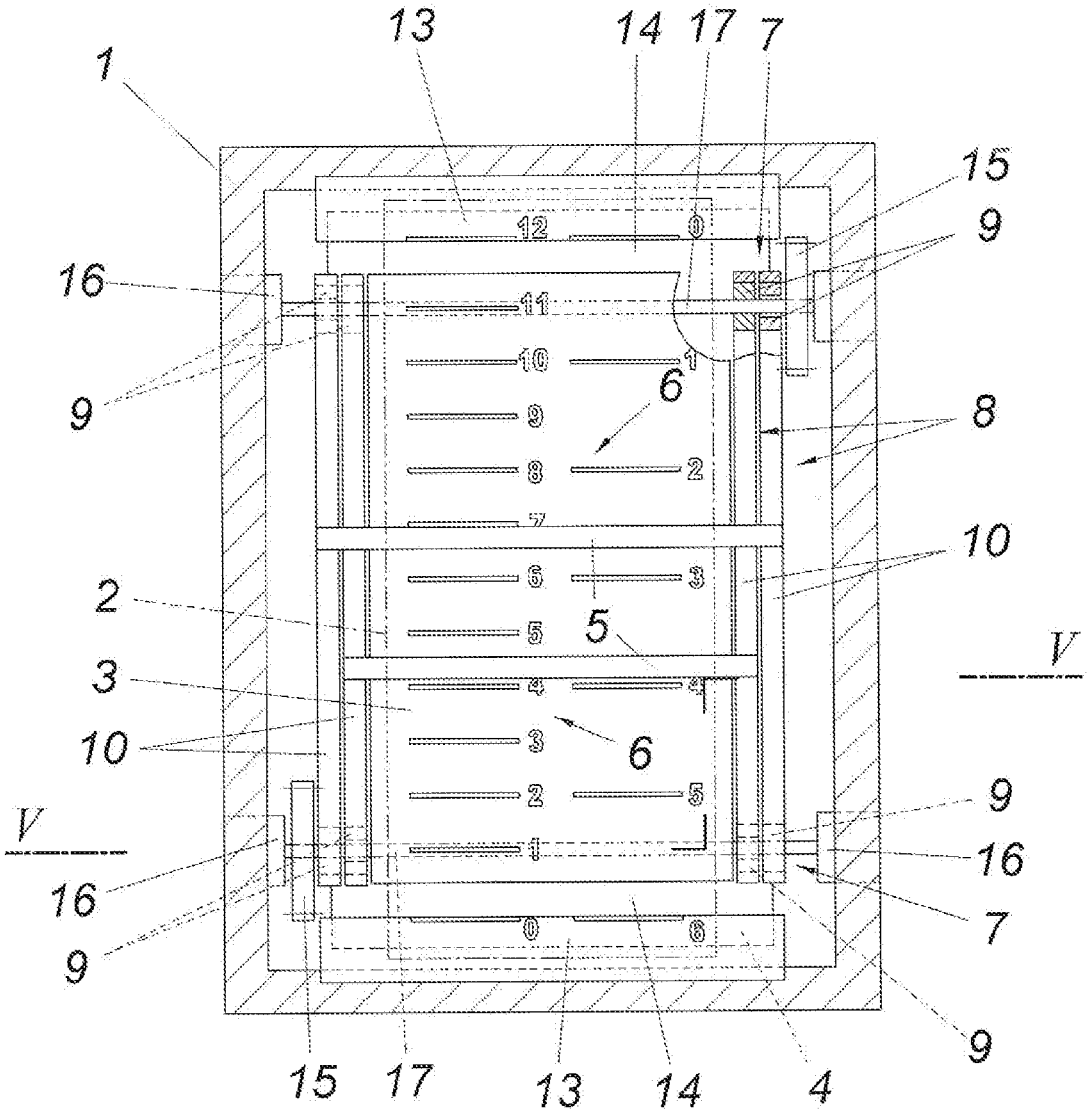
FIG. 4 shows a structural variant of a watch according to the invention in an illustration corresponding to FIG. 1.
Figure 5:
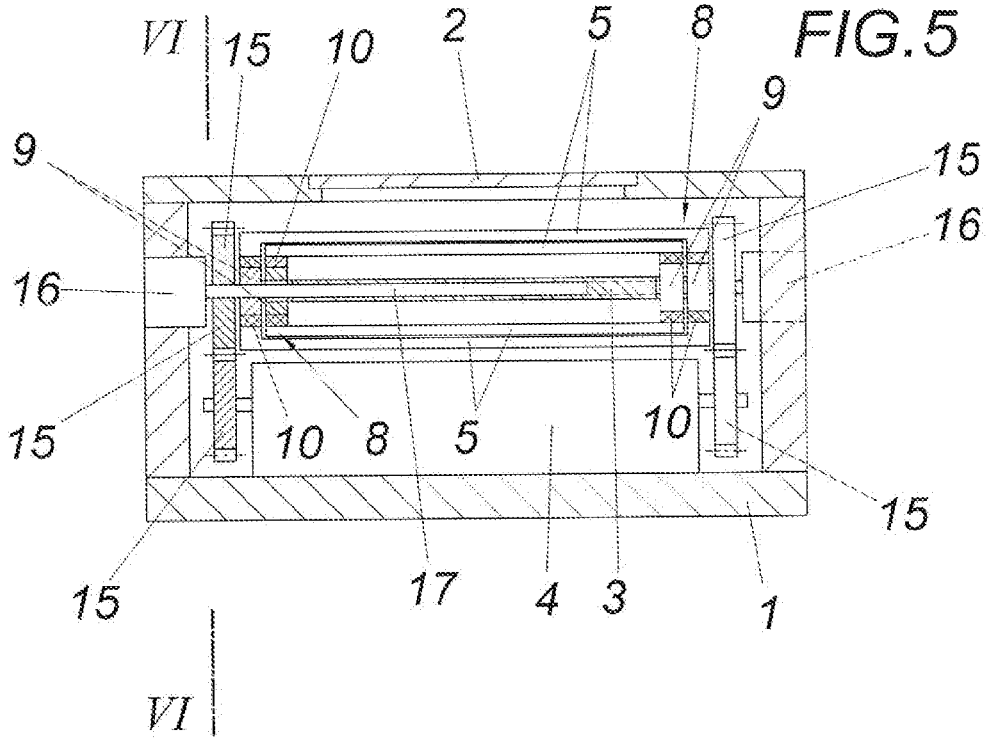
FIG. 5 shows a section along line V-V of FIG. 4.
Figure 6:
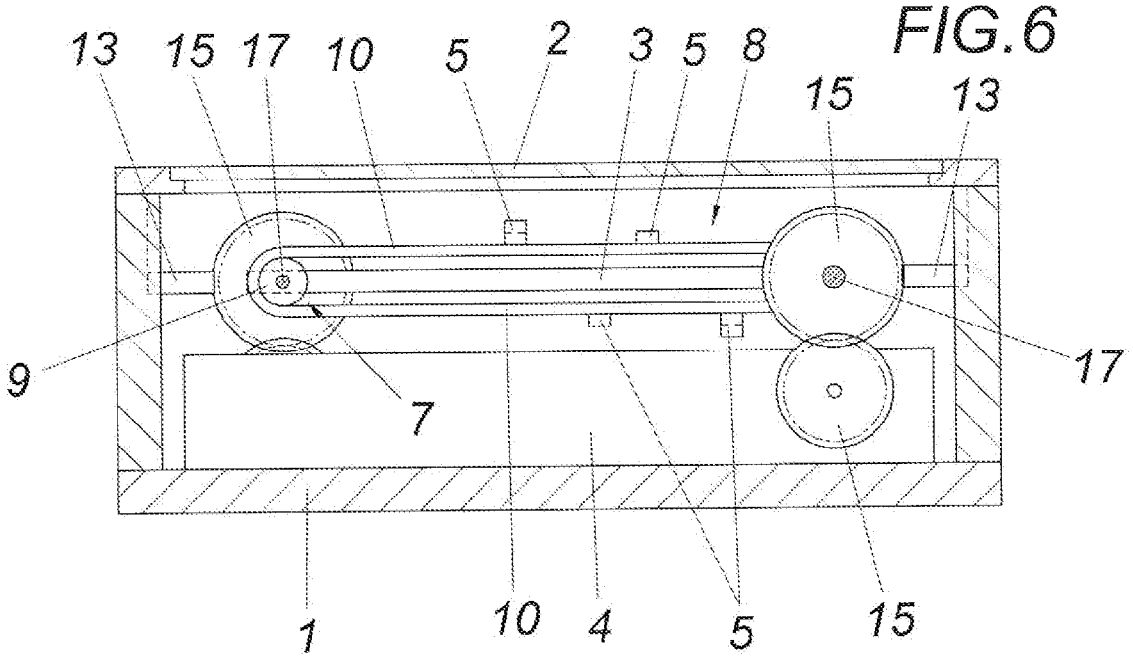
FIG. 6 shows a section along line VI-VI of FIG. 5.

The exemplary embodiment according to FIGS. 4 to 6 differs from that according to FIGS. 1 to 3 above all in that two endless conveyors 8 are provided, which are driven separately from one another, to be able to read off different time units on the basis of different timescales 6 on the shared dial 3. The endless conveyors 8 each have, corresponding to the exemplary embodiment according to FIGS. 1 to 3, two traction mechanism 10 circulating endlessly around deflection rollers 9 as the deflection guides 7 of the endless conveyors 8, which each carry two hands 5 at a spacing corresponding to half the circumferential length of the traction mechanism 10. Since the hands 5 of the two endless conveyors 8 have to be guided past one another as a result of the different circumferential velocities, the hand path of the endless conveyor 3 having the outer traction mechanism 10 overlaps with the hand path of the inner endless conveyor 8, as can be inferred from FIGS. 5 and 6.

Two gearwheel pairs 15, which drive a shared shaft 17 for the respective pair of deflection rollers 9 to be driven, are provided for driving the two endless conveyors 8. These shafts 17 extend through the dial 3, so that the dial 3 can be supported on the shafts 17 as part of the deflection guide 7 and do not require further mounting. Because the deflection rollers 9 of the two endless conveyors 8 extend coaxially, the pair of deflection rollers 9 which is not driven by the respective shaft 17 have to be mounted in a rotatable manner on the shaft 17. Therefore, the deflection wheels 9 of one endless conveyor 8 are driven via the shaft 17 at one end of the dial 3 and the deflection wheels 9 of the other endless conveyor are driven via the shaft 17 on the opposite dial side.

Figure 7:
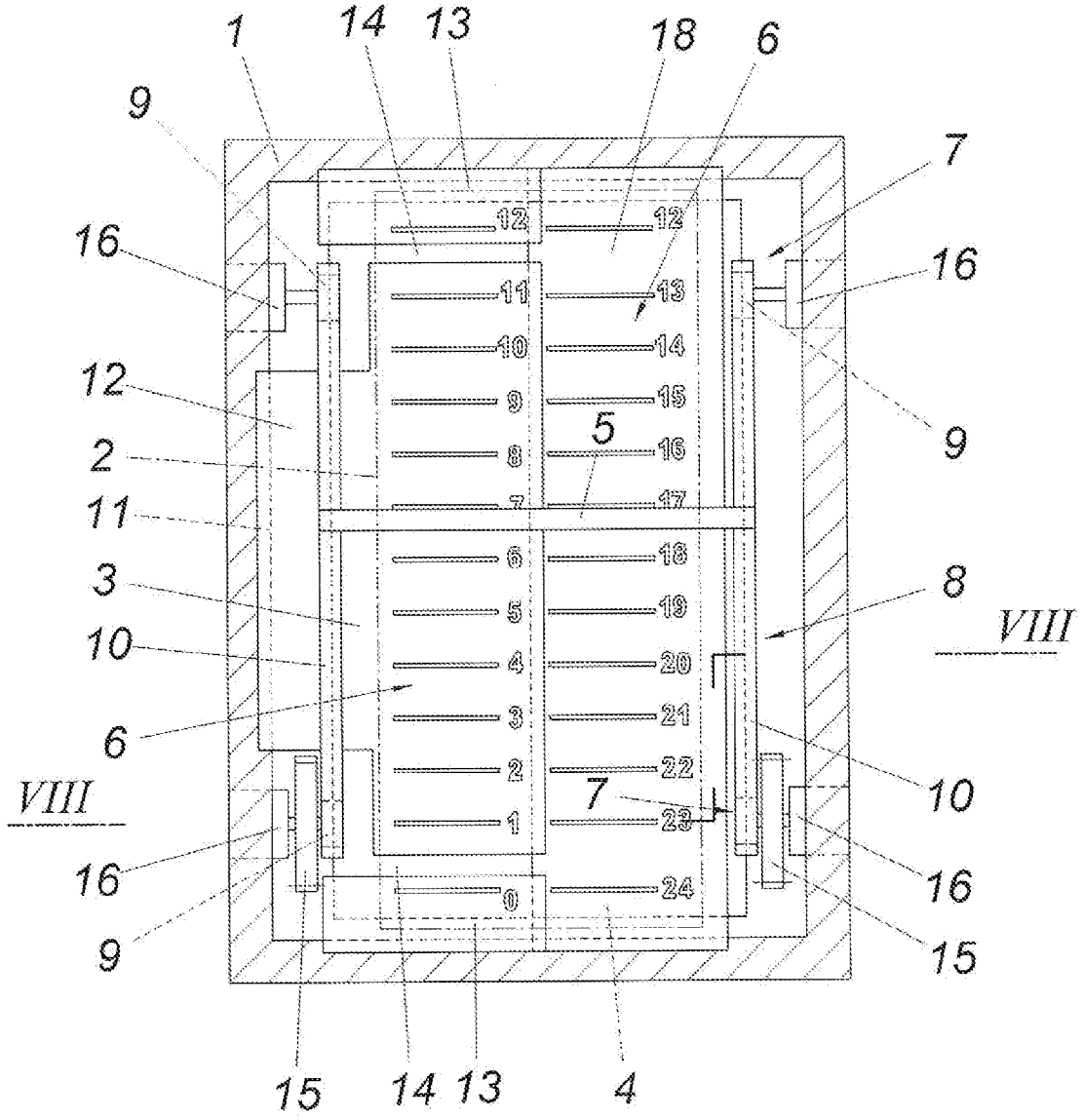
FIG. 7 shows a further structural variant of a watch according to the invention in an illustration corresponding to FIG. 1.
Figure 8:
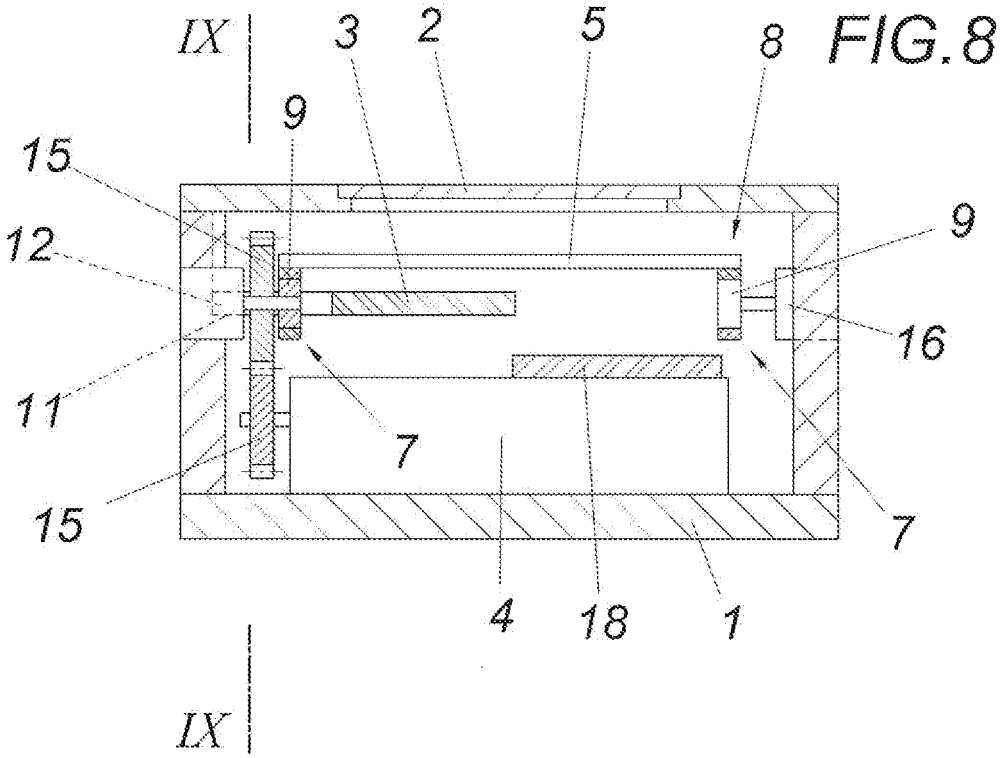
FIG. 8 shows a section along line VIII-VIII of FIG. 7.
Figure 9:
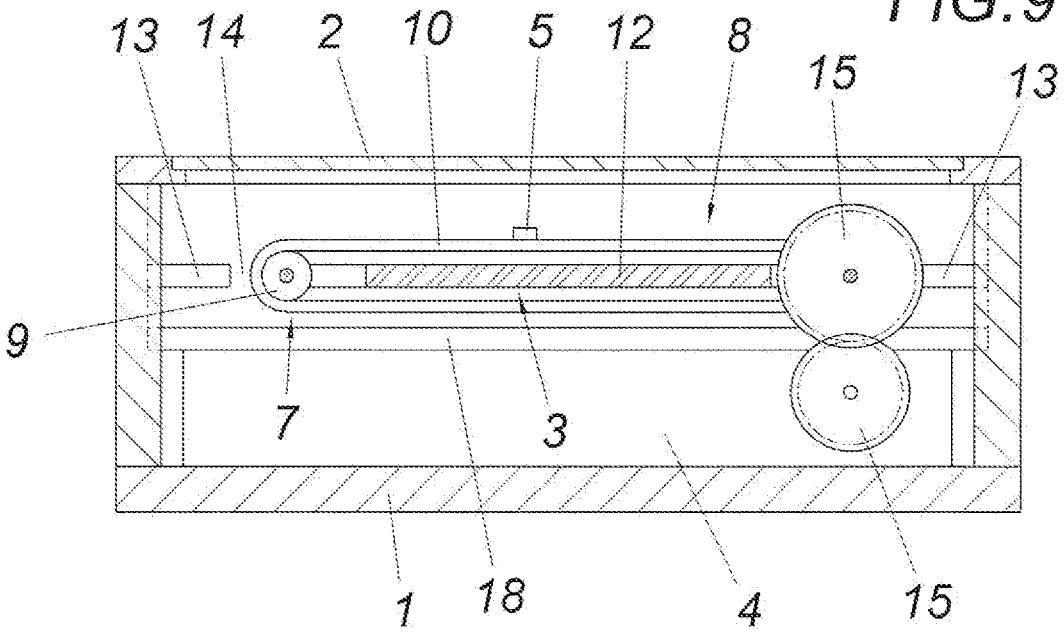
FIG. 9 shows a section along line IX-IX of FIG. 8.

As can be inferred from the exemplary embodiment of FIGS. 7 to 9, a continuous time display using only one hand 5 is also possible if an additional dial 18 is arranged below the endless conveyor 8, because the dial 18 is not concealed by the dial 2 between the sides of the endless conveyor 8. If, in such an embodiment, in which, corresponding to the exemplary embodiment according to FIGS. 1 to 3, the two hands 5 are moved endlessly around deflection rollers 9 of the deflection guides 7 of the endless conveyor 8 above the dial 3, the time is thus told on the basis of the timescale 6 indicated on this dial 3. On the lower side of the dial 3, the hand 5 is concealed in the region of the dial 3, but it remains visible in relation to the additional dial 18, because it is moved above this dial 18. Therefore, the time can also be told along the return path of the hand 5 using only one timescale 6 extending in the opposite direction to the timescale 6 on the additional lower dial 18.

Figure 10:
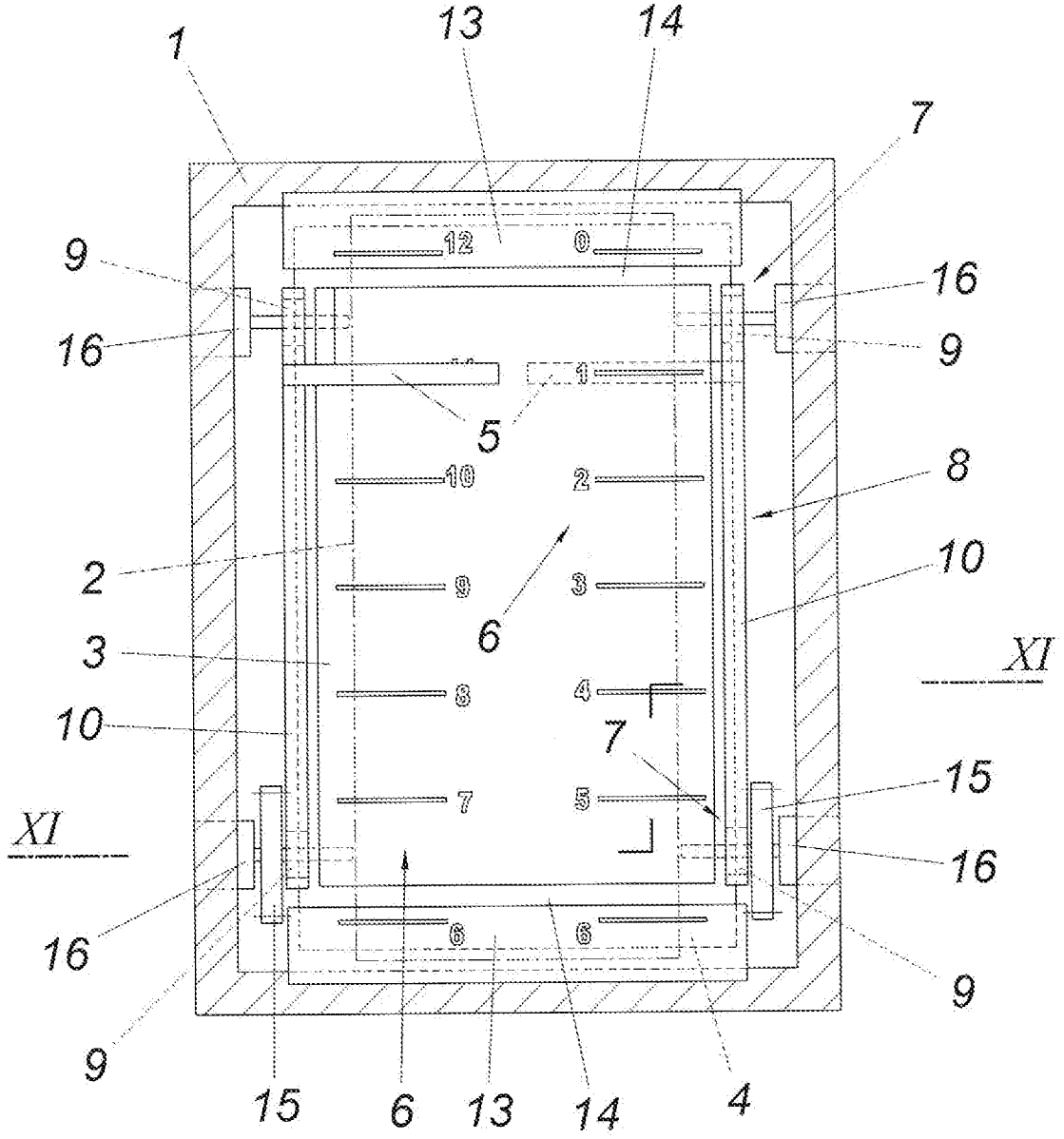
FIG. 10 shows a further structural variant of a watch according to the invention in an illustration corresponding to FIG. 1.
Figure 11:
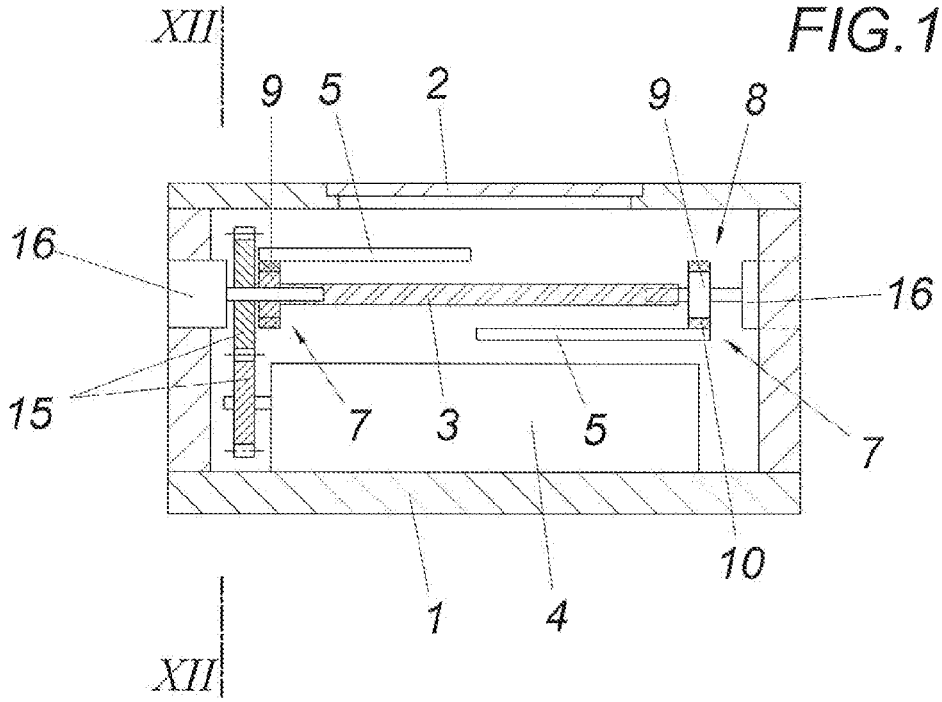
FIG. 11 shows a section along line XI-XI of FIG. 10.
Figure 12:
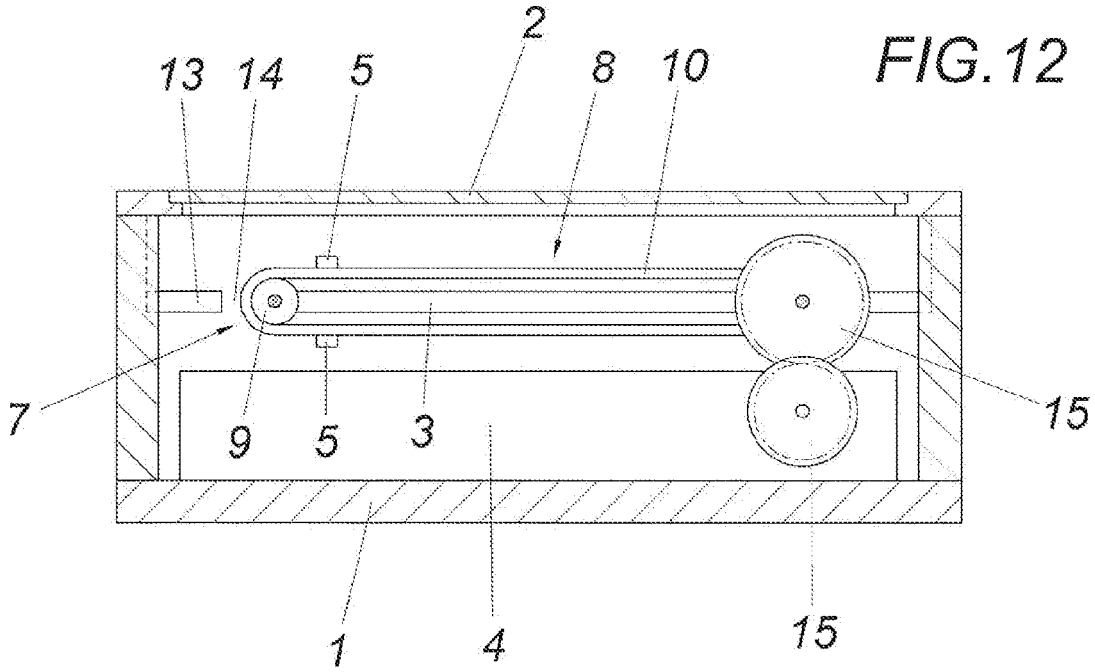
FIG. 12 shows a section along line XII-XII of FIG. 11.

Finally, an exemplary embodiment is shown in FIGS. 10 to 12, in which the hands 5 are only fastened on one side on endless conveyors 8 and therefore protrude freely toward the dial 3. The endless conveyors 8 accordingly have only one traction mechanism 10 guided endlessly around deflection rollers 9. Because, according to this exemplary embodiment, the two endless conveyors 8 are opposite to one another with respect to the dial 3, the hands 5 of the endless conveyors 8 protrude toward one another.

With the aid of these hands 5, different time units can be indicated. However, it is also possible to enable a quasi-revolving time display with the aid of two hands, if the two endless conveyors 8 are driven in opposite directions and are aligned in relation to one another so that the two hands 5 are opposite in the vertexes of the deflection guides 7, so that the hand which disappears at the end of one timescale 6 through the hand passage 14 is replaced by the hand 5 appearing through this hand passage 14 for the other timescale 6.

The dial 3 is mounted on stub shafts or stub axles of the deflection rollers 9. The stub shafts or stub axles protruding beyond the deflection rollers 9 engage in corresponding receptacle boreholes of the dial 3. The dial, is therefore also supported on the deflection guide 7 in this case.

It has been shown that clocks having a variety of hand paths and time displays can be implemented by the arrangement according to the invention of a dial 3 between the sides of at least one endless conveyor 8 for at least one hand 5.

The invention claimed is:

1. A watch having a housing (1), having a dial (3) arranged in the housing (1), having at least one endless conveyor (8), which is guided around two deflection guides (7) having deflection axes parallel to the dial (3), for at least one hand (5), and having a drive for the endless conveyor (8), wherein the dial (3) extending between the two sides at the endless conveyor (8) is mounted on a mount (11), which is either provided laterally outside the orbit of the hand (5) or is fastened laterally outside the orbit of the hand (5).

2. The watch according to claim 1, wherein the dial (3) is supported on the deflection guides (7) of the endless conveyor (8).

3. The watch according to claim 2, wherein the dial (3) is mounted on axes or shafts (17) of the deflection guides (7) designed as deflection rollers (9).

4. The watch according to claim 1, wherein the length of the dial (3) corresponds to the vertex spacing of the two deflection guides (7).

5. The watch according to claim 4, wherein the dial (3) is extended in length by supplementary dial sections (13) while leaving open a hand passage (14).

6. The watch according to claim 1, wherein the endless conveyor (8) has two hands in a mutual spacing corresponding to half of its circumferential length.

7. The watch according to claim 1, wherein the endless conveyor (8) has a single hand (5), which interacts on one side with the dial (3) between the two sides and on the other side with an additional (18), which is arranged below the endless conveyor (8) and is exposed by the dial (3) between the two sides.

8. The watch according to claim 1, wherein the endless conveyor (8) has two endlessly circulating traction mechanisms (10), which are arranged in parallel with lateral spacing and accommodate at least one hand (5)between them.

9. The watch according to claim 8, wherein the deflection guides (7) are designed as deflection rollers (9) and are seated in pairs on a shared shaft (17).

10. The watch according to claim 1, wherein, to indicate different time units, separate endless conveyors (8), which are provided with coaxial deflection guides (7) of equal size, having a shared dial (3) are provided for each time unit, wherein the hand path of the respective outer endless conveyor (8) overlaps that of the inner endless conveyor (8).

* * * * *